US011877679B2

(12) United States Patent
Wendling

(10) Patent No.: US 11,877,679 B2
(45) **Date of Patent: *Jan. 23, 2024**

(54) APPARATUS TO PREVENT CURLING OF A RUG CORNER

(71) Applicant: Just Fur Love, LLC, Boston, MA (US)

(72) Inventor: Allan Wendling, New Lothrop, MI (US)

(73) Assignee: Just Fur Love LLC, Boston, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/849,897

(22) Filed: Jun. 27, 2022

(65) Prior Publication Data

US 2022/0322861 A1 Oct. 13, 2022

Related U.S. Application Data

(63) Continuation of application No. 17/071,783, filed on Oct. 15, 2020, now Pat. No. 11,412,875, which is a (Continued)

(51) Int. Cl.
*A47G 27/04* (2006.01)

(52) U.S. Cl.
CPC ..... *A47G 27/0431* (2013.01); *A47G 27/045* (2013.01); *Y10T 428/14* (2015.01)

(58) Field of Classification Search
CPC ..... A47G 27/0431; A47G 27/045; A47G 27/0418; Y10T 428/14; C09J 7/02; C09J 7/0225; C09J 2203/314; B32B 38/10
See application file for complete search history.

(56) References Cited

U.S. PATENT DOCUMENTS

| | | | |
|---|---|---|---|
| 922,703 | A | 5/1909 | Knapp |
| 1,509,047 | A | 9/1924 | Lindhorst |

(Continued)

FOREIGN PATENT DOCUMENTS

| | | | |
|---|---|---|---|
| CN | 203074180 | U | 7/2013 |
| GB | 264 447 | A | 2/1927 |
| GB | 2 282 965 | A | 4/1995 |

OTHER PUBLICATIONS

International Search Report and Written Opinion for International Application No. PCT/US2022/018699, dated Jun. 21, 2022.

(Continued)

*Primary Examiner* — Patricia L. Nordmeyer
(74) *Attorney, Agent, or Firm* — Wolf, Greenfield & Sacks, P.C.

(57) ABSTRACT

An apparatus to prevent curling of a rug corner including a rigid and planar body having a planar top and planar bottom. The rigid and planar body being a laminate structure and including an adhesive layer having a top surface configured to adhere the body to an underside of the rug corner, an elastomer layer that includes a bottom surface configured to contact the floor surface and prevent slippage between the body and the floor surface, and a rigid layer between the adhesive layer and the elastomer layer configured to maintain the body in rigid form. Upon removal of a protective cover provided over a top surface of the adhesive layer, said body is adherable to the underside of the rug corner by said adhesive whereby said body maintains the rug corner in a flat condition.

13 Claims, 2 Drawing Sheets

Related U.S. Application Data continuation of application No. 16/454,604, filed on Jun. 27, 2019, now Pat. No. 10,806,286, which is a continuation of application No. 15/490,368, filed on Apr. 18, 2017, now Pat. No. 10,357,123, which is a continuation-in-part of application No. 15/196,139, filed on Jun. 29, 2016, now Pat. No. 10,357,122, which is a continuation-in-part of application No. 14/730,849, filed on Jun. 4, 2015, now abandoned, which is a continuation-in-part of application No. 14/542,774, filed on Nov. 17, 2014, now abandoned.

(56) References Cited

U.S. PATENT DOCUMENTS

| | | | |
|---|---|---|---|
| 3,491,053 | A | 1/1970 | Sommer et al. |
| 3,559,273 | A | 2/1971 | Porzio |
| 4,554,194 | A | 11/1985 | Haas et al. |
| 4,681,786 | A | 7/1987 | Brown |
| 5,003,664 | A | 4/1991 | Wong |
| 5,567,497 | A | 10/1996 | Zegler et al. |
| 6,558,786 | B1 | 5/2003 | Jupina |
| 6,673,409 | B1 | 1/2004 | Wheatley |
| 8,468,770 | B2 | 6/2013 | McDonald et al. |
| 10,357,122 | B2 | 7/2019 | Wendling |
| 10,357,123 | B2 | 7/2019 | Wendling |
| 10,368,675 | B2 | 8/2019 | Wendling |
| 10,799,049 | B2 | 10/2020 | Wendling |
| 10,806,285 | B2 | 10/2020 | Wendling |
| 10,806,286 | B2 | 10/2020 | Wendling |
| 11,141,013 | B2 | 10/2021 | Wendling |
| 11,412,875 | B2 | 8/2022 | Wendling |
| 2005/0025926 | A1 | 2/2005 | Risi et al. |
| 2006/0127628 | A1 | 6/2006 | Price |
| 2011/0074128 | A1 | 3/2011 | Chang |
| 2012/0285613 | A1 | 11/2012 | Bongiovanni et al. |
| 2012/0295056 | A1 | 11/2012 | Bieser et al. |
| 2014/0141204 | A1 | 5/2014 | Calkins |
| 2014/0206249 | A1 | 7/2014 | Pearce |
| 2015/0182391 | A1 | 7/2015 | Liu |
| 2016/0029826 | A1 | 2/2016 | Bongiovanni et al. |
| 2016/0302603 | A1 | 10/2016 | Wendling |
| 2017/0215619 | A1 | 8/2017 | Wendling |
| 2018/0049574 | A1 | 2/2018 | Wendling |
| 2019/0313823 | A1 | 10/2019 | Wendling |
| 2019/0313824 | A1 | 10/2019 | Wendling |
| 2019/0313825 | A1 | 10/2019 | Wendling |
| 2021/0022535 | A1 | 1/2021 | Wendling |

OTHER PUBLICATIONS

U.S. Appl. No. 90/015,030, filed May 17, 2022, Wendling.
PCT/US2022/018699, Jun. 21, 2022, International Search Report and Written Opinion.

APPARATUS TO PREVENT CURLING OF A RUG CORNER

CROSS-REFERENCE TO RELATED APPLICATIONS

This application is a continuation of U.S. patent application Ser. No. 17/071,783 filed Oct. 15, 2020, which is a continuation of U.S. patent Application Ser. No. 16/454,604 filed Jun. 27, 2019 (now U.S. Pat. No. 10,806,286), which is a continuation of Ser. No. 15/490,368 filed Apr. 18, 2017 (now U.S. Pat. No. 10,357,123), which is a continuation-in-part of U.S. patent application Ser. No. 15/196,139 filed Jun. 29, 2016 (now U.S. Pat. No. 10,357,122), which is a continuation-in-part of U.S. patent application Ser. No. 14/730,849 filed Jun. 4, 2015, which is a continuation-in-part of U.S. patent application Ser. No. 14/542,774 filed Nov. 17, 2014, all of which are herein incorporated by reference in their entirety.

BACKGROUND OF THE INVENTION

I. Field of the Invention

The present invention is related to a device for preventing curling of a rug corner.

II. Description of Related Art

Many homes, office buildings, and the like use area rugs on the floor for decorative or other purposes. These area rugs are typically rectangular in shape and ideally lie flatly on the floor surface.

Unfortunately, over time, the corners of the rug curl upwardly away from the floor surface. When this occurs, the upwardly curled corner of the rug is not only visually unattractive but also presents a safety hazard in which people can trip on the corner of the rug. This is particularly serious in commercial establishments where people who trip on the upwardly curled corner of the rug may fall and hurt themselves and create legal and financial liability.

SUMMARY OF THE PRESENT INVENTION

The present invention provides an apparatus to prevent curling of a rug corner that overcomes all of the above-mentioned disadvantages of the prior art.

In brief, the apparatus of the present invention comprises a rigid and planar V-shaped body. The body has a planar top and a planar bottom which is spaced from the planar top by a small distance, e.g one eighth of an inch.

An adhesive layer is applied to at least a portion of the top of the body. A removable protective cover is then provided over the adhesive layer to protect the adhesive layer when the apparatus of the present invention is not in use.

When use of the device of the present invention is desired, the protective cover for the adhesive layer is removed. The body is then adhered to the bottom of the rug corner by the adhesive layer. Upon doing so, the rigid and planar V-shaped body maintains the rug corner in a flat condition. Consequently, when the rug corner is again laid on the ground surface, the body is positioned between the floor and the rug corner and not only provides an anti-slip protection for the rug, but also prevents curling of the rug corner.

In another preferred embodiment, the V-shaped body is removably secured to the bottom of the rug by hook-and-pile fasteners. This allows removal of the device for machine washing of the rug.

BRIEF DESCRIPTION OF THE DRAWING

A better understanding of the present invention will be had upon reference to the following detailed description when read in conjunction with the accompanying drawing, wherein like reference characters refer to like parts throughout the several views, and in which.

DETAILED DESCRIPTION OF THE PRESENT INVENTION

Figure 1:
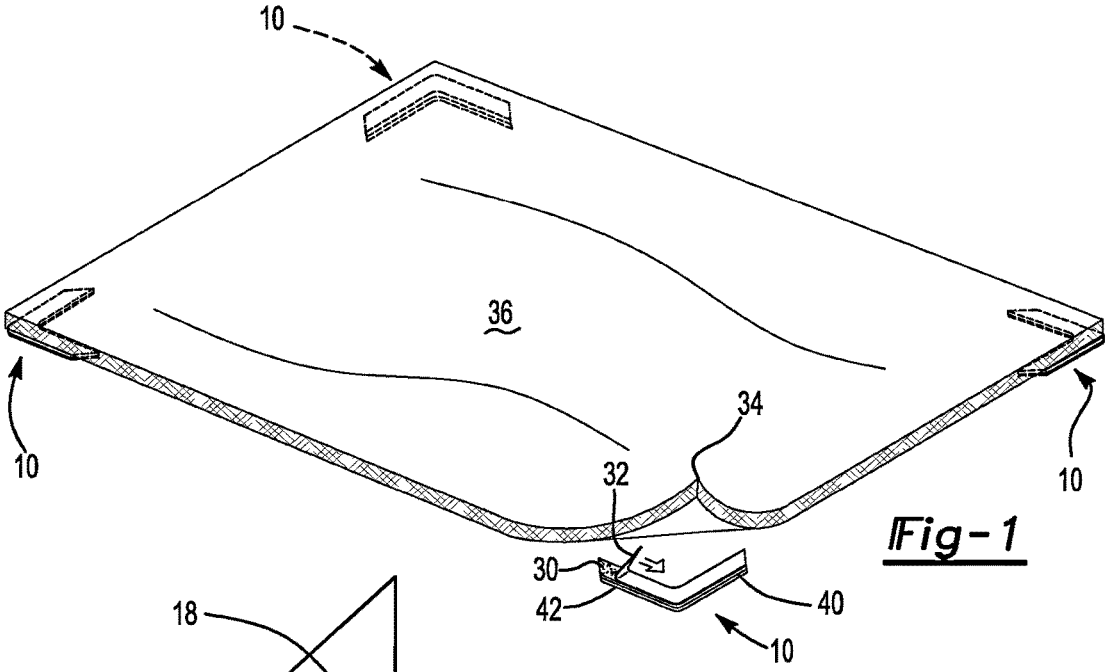
FIG. 1 is an elevational view illustrating the application of the device of the present invention.
Figure 2:
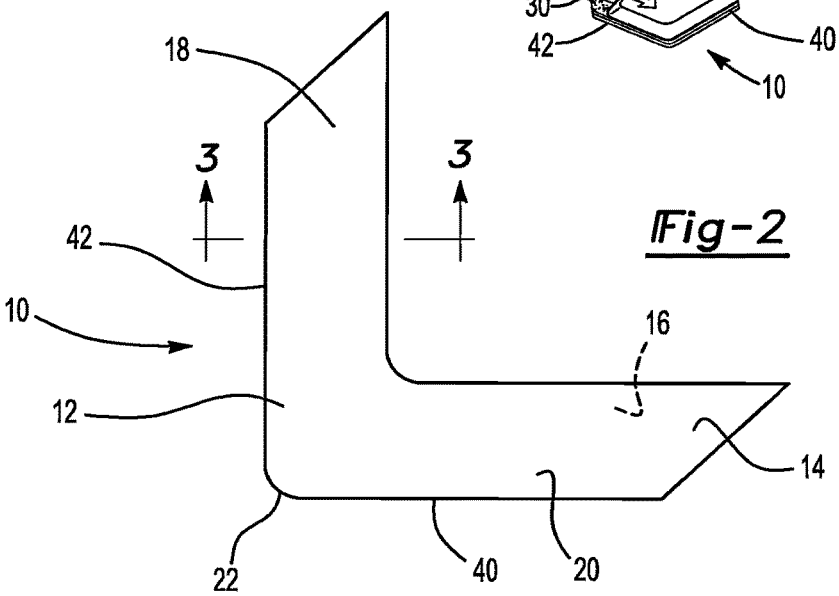
FIG. 2 is atop view illustrating a preferred embodiment of the present invention.

With reference first to FIGS. 1 and 2, a preferred embodiment of the apparatus 10 to prevent curling of a rug corner is shown. The apparatus 10 includes a V-shaped body 12 with a top 14 and bottom 16. The body 12, furthermore, includes two elongated legs 18 and 20 which intersect together generally perpendicularly and with a rounded nose 22.

Figure 3:
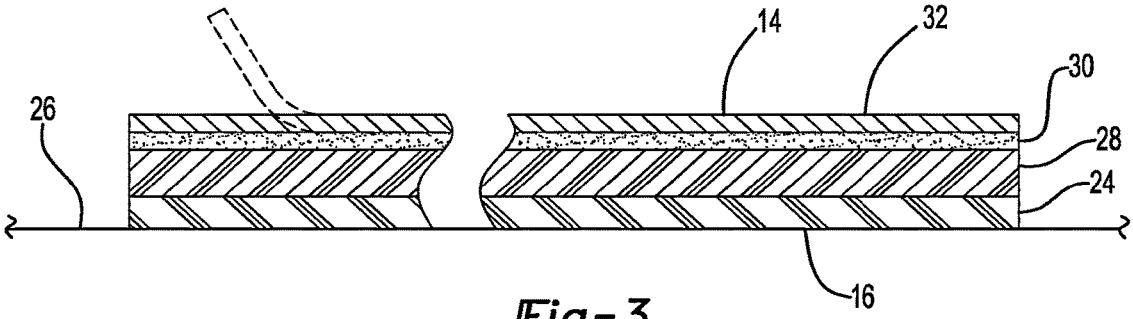
FIG. 3 is a sectional view taken along line 3-3 in FIG. 2 and enlarged for clarity.

As best shown in FIG. 3, the body is a laminate structure and comprises a bottom elastomeric layer 24 of an elastomeric material. This elastomeric material is adapted to abut against a floor surface 26 and, in doing so, prevents slippage between the apparatus 10 and the floor surface 26.

A plastic layer 28, preferably made of polypropylene copolymer, overlies the bottom elastomeric layer 24. The plastic layer 28 is preferably made of a rigid plastic material and maintains the entire body 12 in a rigid form. The plastic layer 28 and elastomeric layer 24 are preferably approximately one eighth of an inch in thickness and are attached together in any conventional fashion. Preferably, the elastomeric layer 24 comprises a sticky gel (polyurethane gel) covered by a removable backing. Alternatively, the bottom layer comprises a synthetic rubber layer such as Santoprene® by ExxonMobil Corporation. Both layers 24 form an anti-slip layer for the rug.

Alternatively, the bottom layer 24 is made of a sticky gel. The sticky gel adheres to the floor to prevent slippage, but without marring or otherwise damaging the floor surface 26.

A thin adhesive layer 30, such as 3M adhesive (acrylic foam tape), is then provided over at least a portion of the plastic layer 28. This adhesive layer 30 is then covered by a protective cover 32, preferably made out of paper or a synthetic material, and which remains attached to the body 12 until use of the apparatus 10 is desired.

With reference now to FIG. 1, when use of the apparatus 10 is desired, the protective cover 32, preferably made of paper, is first removed from the body 12 thus exposing the adhesive layer 30. The body 12 is then aligned with a corner 34 of a rug 36 so that one edge 42 of the one leg 18 of the body 12 extends closely adjacent one edge of the corner 34 of the rug 36 while an edge 40 of the leg 20 of the body 12 extends closely adjacent another edge of the corner 34 of the rug 36.

By pressing the apparatus 10 and leg together, the apparatus 10 is thus adhered to the corner 34 of the rug. When this happens, the rigid and planar body 12 of the apparatus 10 maintains the corner in a flat condition. As the corner is then lowered onto the floor 28, the elastomeric layer 24 contacts the floor 28 and prevents slipping of the corner of the rug. Simultaneously, the rigid body 12 maintains the corner in a flat condition.

Figure 4:
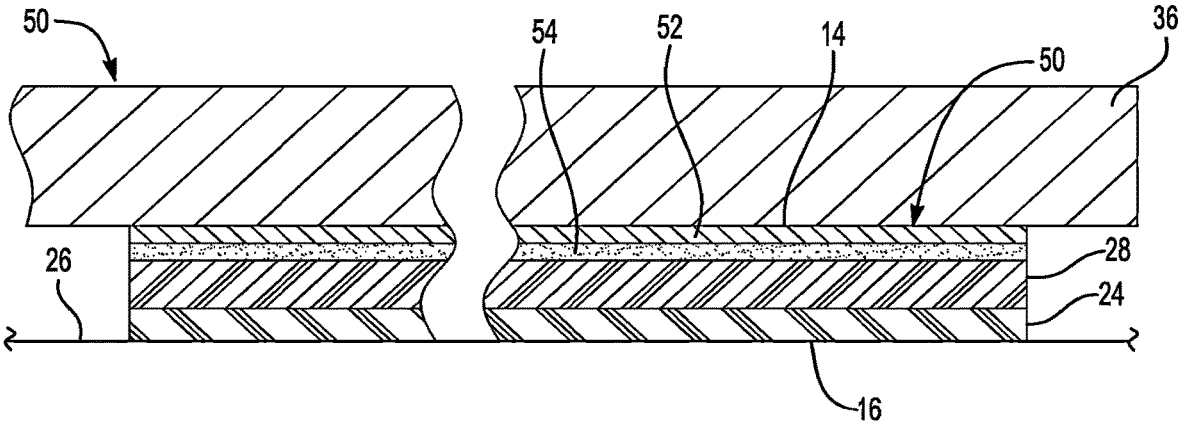
FIG. 4 is a view similar to FIG. 3, but showing a modification thereof.

With reference now to FIG. 4, a modification of the invention is shown in which the plastic layer 28 and elastomeric layer 24 are detachably secured to the rug 36 by a hook-and-pile fastener 50. The hook-and-pile fastener 50, often available under the trademark Velcro®, includes a hook half 52 and pile half 54 which are respectively adhesively secured to the rug 36 and plastic layer 28, or vice versa. The hook-and-pile fastener allows the plastic layer 28 to be easily detached to permit machine washing of the rug.

From the foregoing, it can be seen that the present invention provides a simple yet effective apparatus for preventing curling of rug corners of area rugs. Having described my invention, however, many modifications thereto will become apparent to those skilled in the art to which it pertains without deviation from the spirit of the invention as defined by the scope of the appended claims.

I claim:

1. An apparatus to prevent curling of a rug corner away from a floor surface, the apparatus comprising:

a rigid and planar body having a planar top and planar bottom, the rigid and planar body being a laminate structure and including:

an adhesive layer at the planar top of the body and having a top surface configured to adhere the body to an underside of the rug corner;

an elastomer layer at the planar bottom of the body that includes a bottom surface configured to contact the floor surface and prevent slippage between the body and the floor surface; and a rigid layer between the adhesive layer and the elastomer layer configured to maintain the body in rigid form; and a protective cover provided over the top surface of the adhesive layer and removable from the top surface of the adhesive layer to expose the adhesive layer for adhering to the underside of the rug corner, wherein upon removal of said protective cover and exposure of said adhesive layer, said body is adherable to the underside of the rug corner by said adhesive layer whereby said body maintains the rug corner in a flat condition.

2. The apparatus of claim 1, wherein the rigid layer includes a layer of rigid plastic material.

3. The apparatus of claim 2, wherein the adhesive layer is attached directly to the rigid layer.

4. The apparatus of claim 2, wherein the elastomer layer is attached directly to the rigid layer.

5. The apparatus of claim 2, wherein the elastomer layer includes a sticky gel.

6. The apparatus of claim 5, wherein the elastomer layer includes a sticky polyurethane gel.

7. The apparatus of claim 2, wherein the elastomer layer includes a synthetic rubber layer.

8. The apparatus of claim 1, wherein the body includes a pair of parallel edges that are parallel to each other and an end that extends between the parallel edges at a transverse angle to the parallel edges.

9. The apparatus of claim 1, wherein the body includes first and second side edges that are parallel to each other and an end edge that extends between the first and second side edges, the end edge defining an obtuse angle with the first side edge and defining an acute angle with the second side edge.

10. The apparatus of claim 9, wherein the body includes an edge opposite the end edge that is perpendicular to the first side edge.

11. The apparatus of claim 1, wherein the body includes first, second and third edges that together define a part of a trapezoid.

12. The apparatus of claim 11, wherein the first and second edges define bases of the part of the trapezoid and the third edge defines a leg of the part of the trapezoid.

13. An apparatus to prevent curling of a rug corner away from a floor surface, the apparatus comprising:

a rigid and planar body having a planar top and planar bottom, the rigid and planar body being a laminate structure and including:

an adhesive layer defining the planar top of the body and having a top surface configured to adhere the body to an underside of the rug corner;

an elastomer layer defining the planar bottom of the body that includes a bottom surface configured to contact the floor surface and prevent slippage between the body and the floor surface; and a rigid plastic layer between the adhesive layer and the elastomer layer configured to maintain the body in rigid form;

a removable backing covering the bottom surface of the elastomer layer; and a protective cover provided over the top surface of the adhesive layer and removable from the top surface of the adhesive layer to expose the adhesive layer for adhering to the underside of the rug corner, wherein upon removal of said protective cover and exposure of said adhesive layer, said body is adherable to the underside of the rug corner by said adhesive layer whereby said body maintains the rug corner in a flat condition.

* * * * *